US005383669A

United States Patent [19]

Vance

[11] Patent Number: 5,383,669

[45] Date of Patent: Jan. 24, 1995

[54] EQUESTRIAN BOARD GAME

[76] Inventor: Jack Vance, 4720 Buckeystown Pike, Frederick, Md. 21701

[21] Appl. No.: 117,811

[22] Filed: Sep. 8, 1993

[51] Int. Cl.[6] ..... A63F 3/00

[52] U.S. Cl. ..... 273/244

[58] Field of Search ..... 273/242, 243, 244, 246, 273/248, 249, 259, 271

[56] References Cited

U.S. PATENT DOCUMENTS

| | | | |
|---|---|---|---|
| 3,511,504 | 5/1970 | Mann et al. | 273/244 |
| 3,907,295 | 9/1975 | Eissler | 273/244 |
| 3,997,167 | 12/1976 | Kratzer | 273/244 |
| 4,007,937 | 2/1977 | Casciano et al. | 273/244 |
| 4,093,238 | 6/1978 | Moskowitz . | |
| 4,141,560 | 2/1979 | Kaslow | 273/244 |
| 4,346,899 | 8/1982 | Nuebling | 273/244 |
| 4,583,741 | 4/1986 | Brisciano . | |
| 4,813,681 | 3/1989 | Volpert | 273/271 |
| 4,856,780 | 8/1989 | Begley et al. | 273/244 |
| 4,890,843 | 1/1990 | Chauve . | |
| 5,123,653 | 6/1992 | Murphy | 273/244 |

FOREIGN PATENT DOCUMENTS

| | | | |
|---|---|---|---|
| 2048083 | 12/1980 | United Kingdom | 273/244 |
| 1587797 | 4/1981 | United Kingdom | 273/244 |
| 2130897 | 6/1984 | United Kingdom | 273/244 |
| 2134395 | 8/1984 | United Kingdom | 273/244 |
| 2225730 | 6/1990 | United Kingdom | 273/244 |

OTHER PUBLICATIONS

"Farook", *Games*, Jun. 1993, p. 51.

*Primary Examiner*—William E. Stoll

[57] ABSTRACT

An educational board game having three courses each representing an event in equestrian competition is won by accumulating the most points while moving playing pieces around the courses in response to the roll of a die. Landing positions on the three courses allow the players to earn points by correctly defining equestrian terms or to select cards containing instructions or questions. An additional playing piece may participate in the game and is controlled by each of the players in sequential turn. The points accumulated by the additional playing piece are awarded to the first player to complete a game course.

7 Claims, 5 Drawing Sheets

FIG. 1
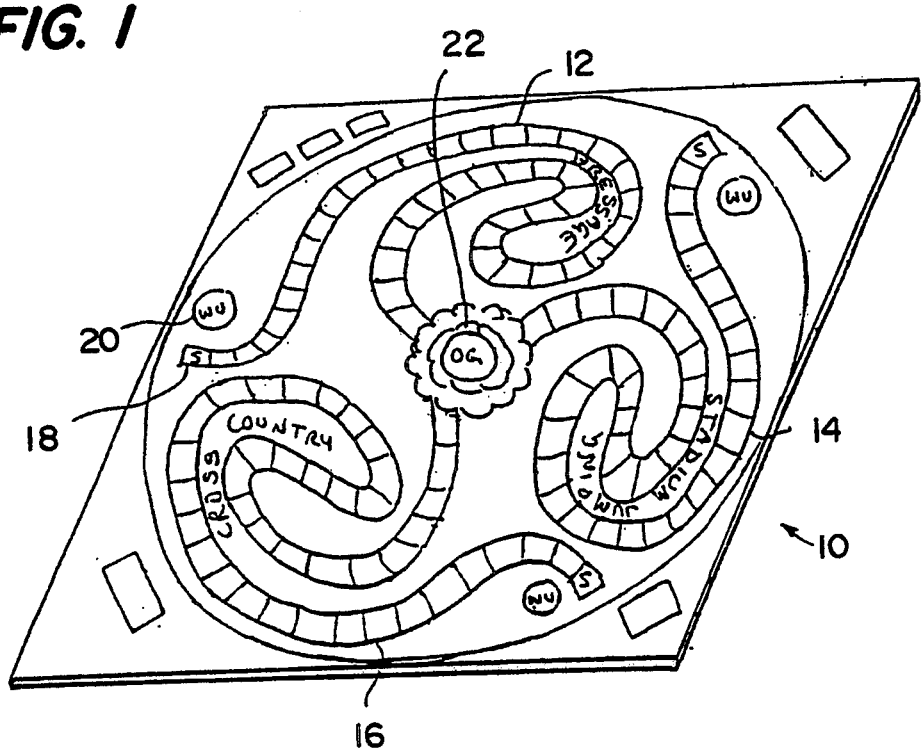
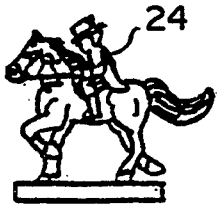
FIG. 2A
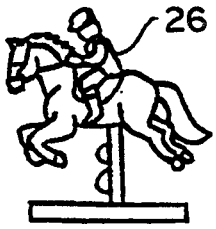
FIG. 2B
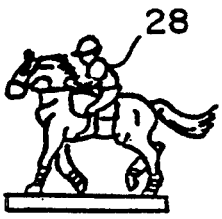
FIG. 2C
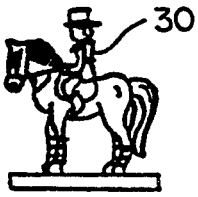
FIG. 2D

EQUESTRIAN BOARD GAME

BACKGROUND OF THE INVENTION

1. Field of the Invention

The present invention pertains to board games and, more particularly, to board games involving skill, chance and knowledge of equestrian terminology.

2. Discussion of the Prior Art

A number of board games exist that combine the movement of playing pieces around a board in response to numbers produced by rolls of dice, turns of a spinner, or the drawing of cards. Some of these games are won by the first to complete a course laid out on the board, others by the player who accumulates the most game points along the way. U.S. Pat. No. 3,997,167 to Kratzer shows a board game consisting of several independent events each of which is governed by spinner-generated numbers. The players acquire points in each event according to order of finish and the game is won by the player accumulating the most points. U.S. Pat. No. 4,890,843 to Chauve describes a board game having a master course around which players move in response to dice rolls and also having side games associated with various positions on the master course optionally available to the players landing on those positions. U.S. Pat. No. 4,093,238 to Moskowitz discloses a horse-racing game using selection tiles randomly drawn to determine characteristics associated with each player's horse and randomly selected movement tiles to advance or score points for each characteristic. Victory is decided by accumulated characteristic points.

Numerous other board games exist, many employing helpful or penalizing instruction cards issued in response to movement of game pieces, tests of knowledge to add or subtract game points, and multiple courses to be played in sequence. None of these games combines skill and chance in a format both entertaining and instructive in combined training equestrian events.

SUMMARY AND OBJECTS OF THE PRESENT INVENTION

Accordingly, it is a primary object of the present invention to overcome the above-mentioned shortcomings in the prior art by providing a board game based on combined training equestrian events such as dressage, stadium jumping and cross-country events of modern equestrian games.

Another object of the present invention is to provide a board game combining random chance with rewards for knowledge.

A further object of the present invention is to teach the language and philosophy of show horse training in an entertaining board game.

Yet another object of the present invention is to provide a game employing an initially unassigned playing piece to be strategically controlled sequentially by the game players to accumulate points subsequently awarded to the player first to complete a game segment.

Some of the advantages of the present invention over the prior art are that entertaining competition is combined with basic familiarization with equestrian terminology, various levels of skill and gamesmanship are equally stimulated by the unusual format and rules, yet the play remains accessible to even young children, and the game is of simple and economical manufacture.

The present invention is generally characterized in an educational game, played on a board, foldable for ease of storage, on which three separate courses are printed, each course comprising a sequence of landing positions labeled either by terms related to the events of combined training equestrian event competition, or by directions to draw an instruction card from one of three stacks labeled "Good Luck", "Bad Luck" or "Puissance", a number of playing pieces to indicate player positions in each of the courses, a cup and die for rolling random numbers to control the advance of the pieces, and an additional strategic playing piece to be controlled by each player in turn.

Other objects and advantages of the present invention will become apparent from the following description of the preferred embodiment taken in conjunction with the accompanying drawings.

BRIEF DESCRIPTION OF THE DRAWINGS

FIG. 1 is a perspective view of the game board of the present invention.

FIGS. 2*a*, 2*b*, 2*c* and 2*d*; are side views of four respective types of playing pieces of the present invention.

DESCRIPTION OF THE PREFERRED EMBODIMENT

Figure 3:
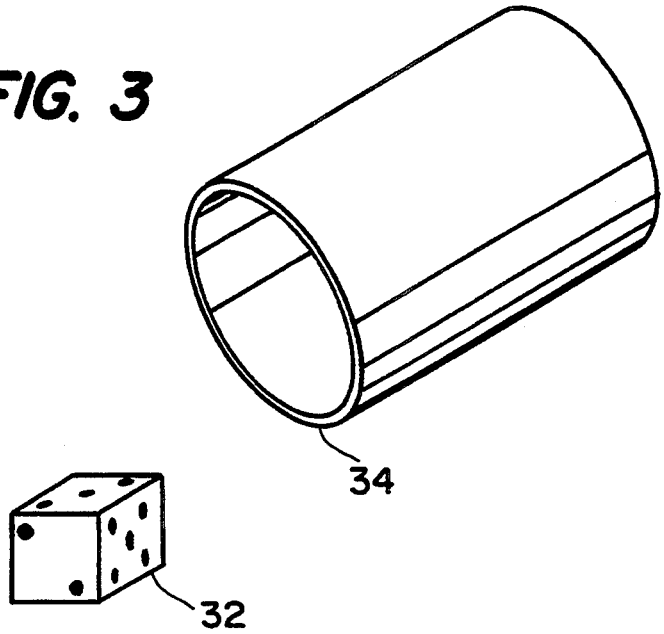
FIG. 3 is a perspective view of the die cup and die of the present invention.

The combined training equestrian event board game of the present invention is played on a game board 10 shown in FIG. 1. The board is divided into three courses, 12, 14 and 16 representing events in an actual combined training equestrian event competition, namely dressage, stadium jumping and cross-country, respectively. Each course begins with a "Start" position 18 located near the edge of the board, has a "Warm-Up Ring" 20 located near the start, and finishes in a common central circle, the Olympia Gold circle 22. Players use game pieces 24, 26, 28 and 30 symbolic of dressage riding, stadium jumping, cross-country riding and unified riding, respectively, shown in FIGS. 2*a*, 2*b*, 2*c* and 2*d*, respectively, to mark positions and progress on the board. Movement of the game pieces is controlled by a random number determined by the player as for instance by the roll of a die 32 from a die cup 34 as shown in FIG. 3. A spinner, drawing of cards, or other means of producing random numbers within a selected range could be similarly used.

Figure 7:
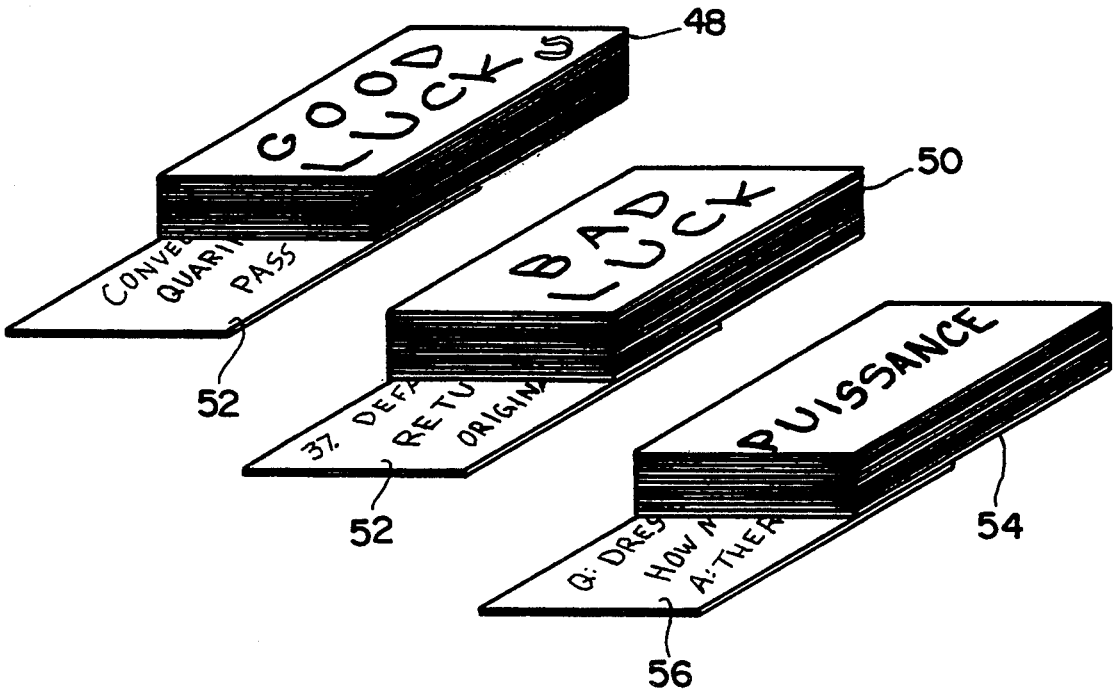
FIG. 7 is a perspective view of the three stacks of instruction cards of the present invention.
Figure 4:
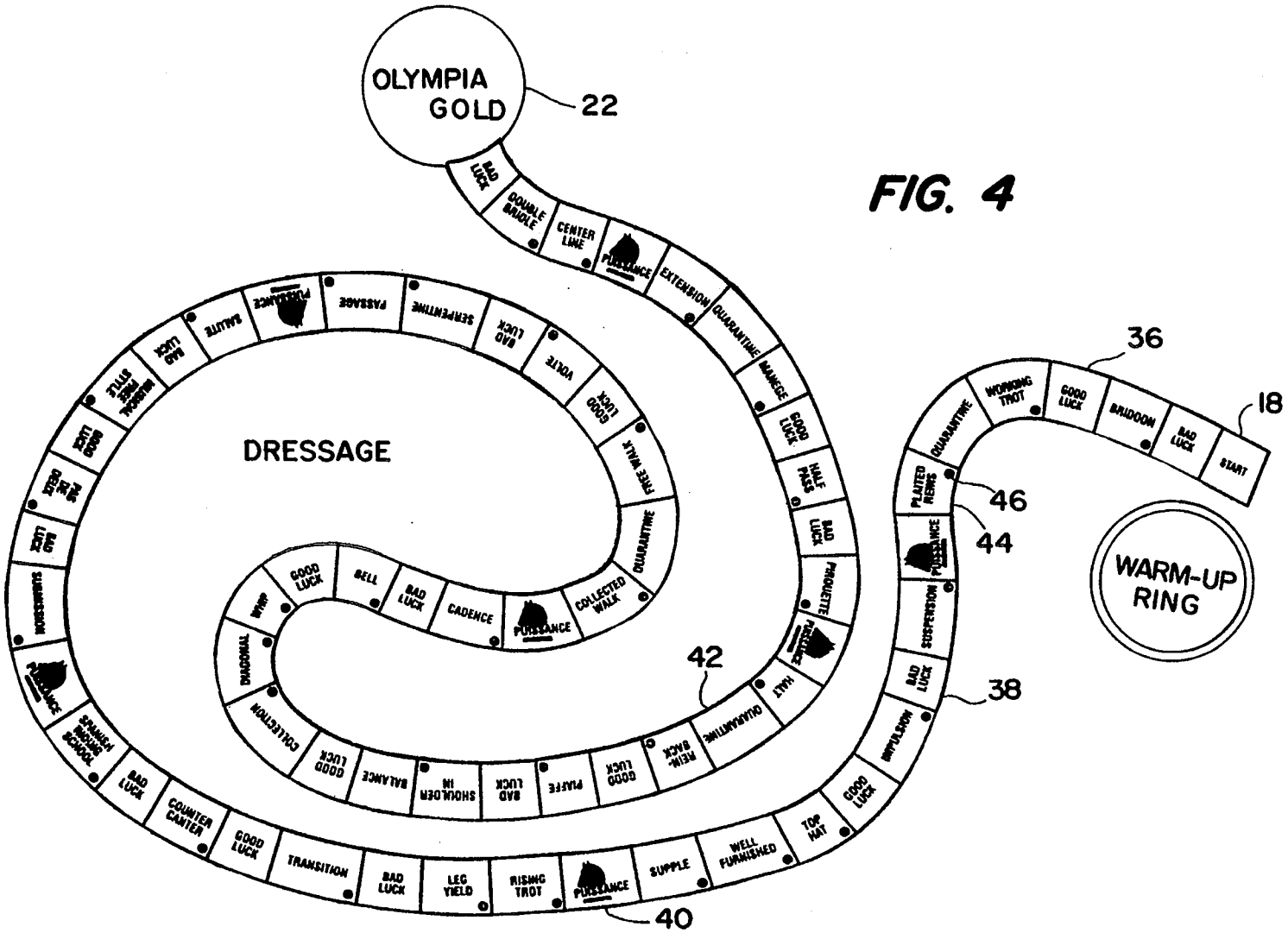
FIG. 4 is a plan view of the "Dressage" course portion of the game board of the present invention.
Figure 5:
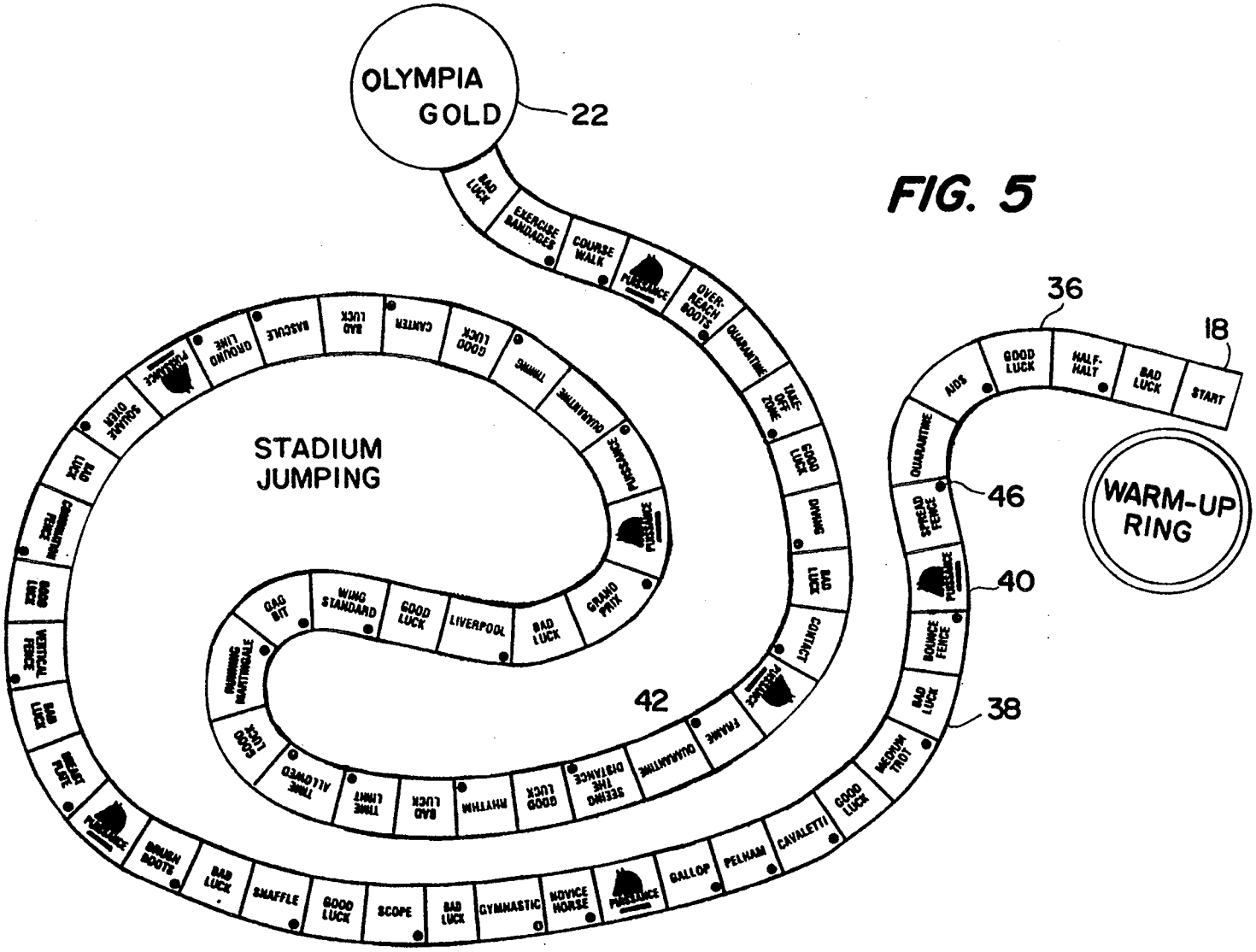
FIG. 5 is a plan view of the "Stadium Jumping" course portion of the game board of the present invention.
Figure 6:
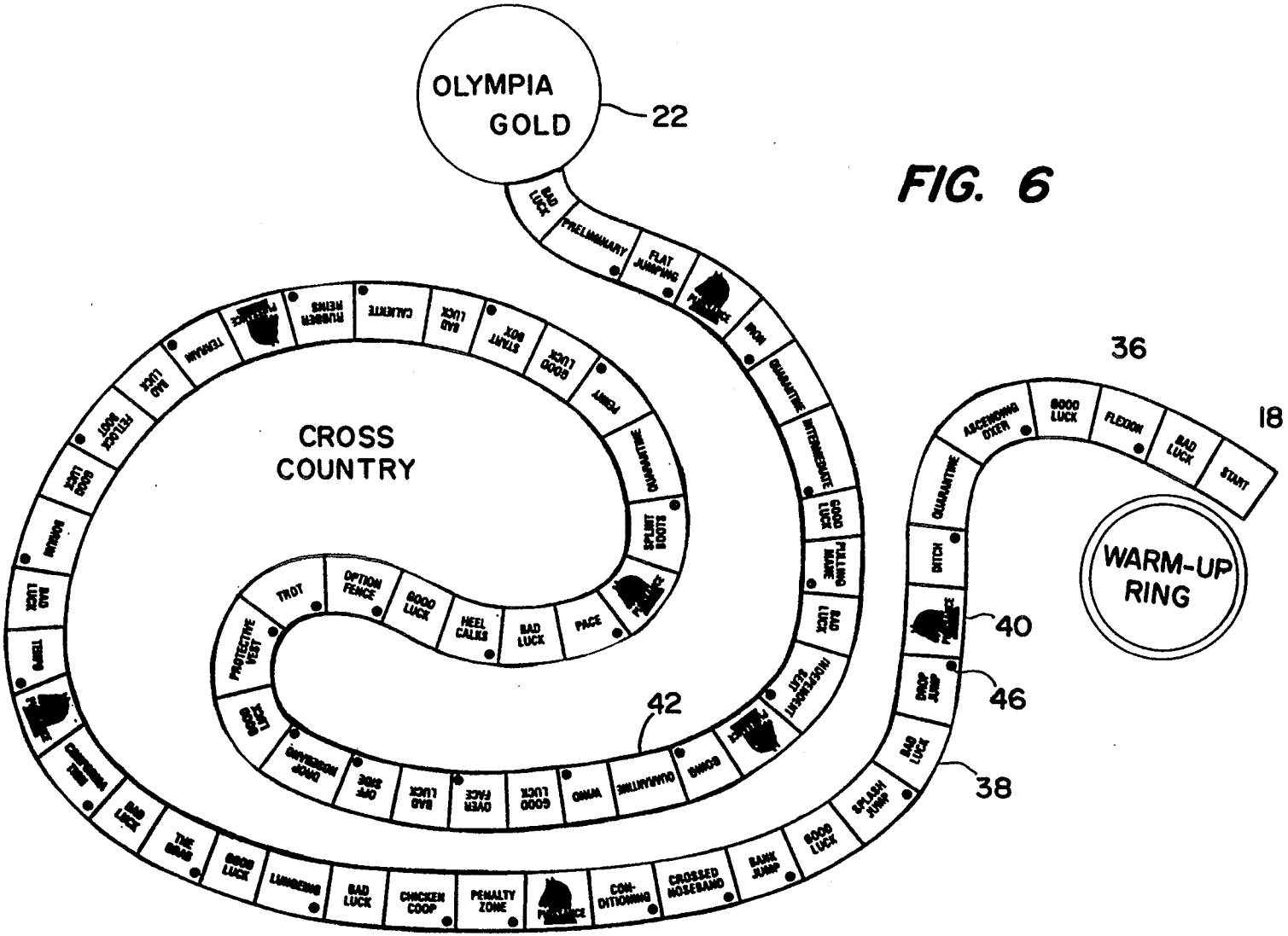
FIG. 6 is a plan view of the "Cross Country" course portion of the game board of the present invention.

FIGS. 4, 5 and 6 show each of the three event courses, dressage 12, stadium jumping 14 and cross-country 16, respectively, made up of individual landing positions. Each course has seventy landing positions with the first, outermost position being "Start" 18 and the succeeding sixty-nine positions distributed among positions labeled "Good Luck" 36, "Bad Luck" 38, "Puissance" 40, "Quarantine" 42, or a term 44 associated with actual combined training equestrian events and competition such as "Plaited Reins", and a final completion position, the Olympic Gold circle 22. Each of the landing positions labeled with terms also has a circled game point value 46 ranging from one to six, awarded to players whose game pieces move onto these landing positions. Players can then gain additional game points by correctly defining the term on the landing position to match the definition in a glossary (not shown) accompanying the game. When a game piece is moved onto a "Good Luck" or "Bad Luck" landing position, the player selects a card from stacks of such cards, shown as 48 and 50, respectively, in FIG. 7 and responds to instructions 52 contained thereon. "Good Luck" cards contain short descriptions of fortunate circumstances and award the player with point values or passes useful in the play of the game. "Bad Luck" cards describe equestrian setbacks and deduct points from the player. A player landing on a "Puissance" position selects a card from the "Puissance" stack 54 and attempts to earn game points by correctly answering the question 56 thereon. Landing on a "Quarantine" position requires the player to miss a turn unless a "Quarantine Pass" card, acquired by draw from the "Good Luck" card stack, can be played.

The unified rider playing piece 30 can optionally be used as an additional strategic player controlled in turn by each player to accumulate game points that are then awarded to the first player to complete the course by reaching the Olympia Gold circle, or by meeting some other prespecified game condition.

The sequence of game play and the relevant terms, phrases and instructions included in the game are presented below.

GAME CONCEPT

The player or team accumulating the most points "Wins the Gold". In instances of ties, the first player or team to reach the Olympia Gold circle wins. Reaching the Olympia Gold circle first does not necessarily mean a player wins; the goal is to obtain the most points.

The game is played in sequence, Dressage first, continuing on to Cross Country, and finally Stadium Jumping totaling a player's score for all three just as in real combined training equestrian events; or it is played simultaneously, all three phases at the same time, as individuals or teams. The object is to accumulate as many points as one can passing through each phase of the game. To reach the Olympia Gold circle a player must roll the exact number required to land on the center of the board. Players experience anxious moments when they use the "Unified Rider Disqualifying Cards." If the cards are played too soon, they could cost an individual player or the team the game. If the cards are played too late, the competition could gain control of the Unified Rider points. There are three "Unified Rider Reinstatement Cards" in the Good Luck deck. The Puissance Cards containing extra points give players the opportunity to advance if they are able to answer the questions.

TO BEGIN

Each player rolls the die. The player to roll the highest score receives first choice of game piece and event in which to compete. Players may compete in events simultaneously or in the sequence of Dressage, Cross Country, and then Stadium as individuals or teams.

GETTING ON THE BOARD

A player must qualify to enter play. To get on the start landing position, a player must roll a 1, 3 or 6. Each player is allowed to roll only once per turn and must then pass the die to the next player.

TO MOVE ON

To proceed from the start landing position, a player rolls the die and then moves the number of landing positions indicated by the die. The player follows the instructions on the landing position. Each term landing position has a specific point value, and depicts a piece of equipment, an event, or a movement. If the player properly defines the term, he gains TWO BONUS POINTS. The player's turn is ended when that player picks up the die from the board. Sliding the die to view the board does not constitute ending a turn. The rolled die must stay on the board and come to rest flat on the playing surface. It is best for a player to count the number of landing positions to be moved before actually moving a playing piece.

TERM LANDING POSITIONS

Each term landing position has a point value and in addition a term for which players receive additional points if they define it correctly as described in a supplied Glossary of Terms. These terms are to help the player become familiar with and understand the language used in combined training equestrian events.

GOOD AND BAD LUCK LANDING POSITIONS

When a player lands on a space marked "Good Luck" or "Bad Luck", a card must be drawn from the associated set of cards and its instructions must be followed by the player.

Entering the Olympia Gold circle, or moving backward off the board as directed by a card, is permitted. Once off the board, players must roll a 1, 3 or 6 to get back on the board. Once used, cards should be placed at the bottom of the deck.

QUARANTINE LANDING POSITIONS

A player loses a turn when landing on a Quarantine position unless he chooses to use a quarantine pass card. There are three of these cards in the "Good Luck" deck. Possession of pass cards need not be disclosed, and the cards may be passed from one player to another on the same team.

PUISSANCE LANDING POSITIONS

The person to the right of whose turn it is will ask the question appearing on the card; if the player is able to answer correctly, as it appears on the card, he gains points. If he answers incorrectly, he must return to his previous position.

THE UNIFIED RIDER

The Unified Rider is an independent pawn controlled by a designated player, or control can be transferred on a rotational basis to each player or team captain.

The Unified Rider concept is a unique game feature and may be used regardless of the number of players; it is a strong strategy piece to be used by all players. The person or team captain to roll last at the start of the game is the first person to roll for the Unified Rider. The responsibility of rolling for the Unified Rider passes from captain to captain (if playing as individuals—person to person) throughout the game. A designated player may be used in which case that player rolls for himself. The Unified Rider may choose to look at the other players as competitors or teammates on any given roll, regardless of the event in which they are competing. When the first person reaches the Olympia Gold circle, the Unified Rider piece and all benefits become the responsibility of that player and/or a member of that team.

MORE ABOUT THE UNIFIED RIDER

Young children may find the game easier by omitting the Unified Rider until they learn the game. The pawn, depicting the horse at the levade position is the Unified Rider piece.

1) The first player to reach the Olympia Gold circle gains all control, benefits, and points belonging to the Unified Rider.

2) The Unified Rider rolls in rotation as does every other player.

3) The Unified Rider actually becomes a member of the team of the captain who rolls the die for that turn; therefore, any rules that apply to the other players apply to the Unified Rider as well.

4) The course the Unified Rider plays on is determined by rolling the die. If a "1" is rolled, the Unified Rider plays the Dressage course; if "2" is rolled the Cross Country course is played; if "3" is rolled the Stadium course is played or the course is chosen by mutual agreement. When there is a permanent Unified Rider, the roll, event, executions, instructions or the movement is totally the decision of that individual.

5) The Unified Rider can accumulate any and all cards. When there is a rotating player, the cards move with the Unified Rider. When there is a permanent player, the cards stay with that player.

6) The Unified Rider may not disqualify himself with a card.

7) The Unified Rider may however, reinstate himself with a card.

8) If the Unified Rider is not on the board when the last player reaches the Gold Olympia circle he remains out of play.

GAME RULES

The game may be played in a simultaneous mode with all three phases played at the same time, or it may be played in sequential mode, one phase followed by the next until all three have been played. When playing simultaneously, the rules do not differ for individuals or teams.

When playing in sequence, the following applies:

1) Starting with Dressage, the first person to reach the Olympia Gold circle gains control of all movement, benefits, and points of the Unified Rider.

2) The Unified Rider's points stop accumulating when he completes the course. The same applies throughout each event.

3) The Unified Rider may only be disqualified or reinstated by a player who is on the same course as the Unified Rider.

4) If the Unified Rider is not on the board when the last player reaches the Olympia Gold circle, he proceeds to the next event with the other players.

The points begin to accumulate again in the next phase and are awarded to the person who reaches the Olympia Gold circle first in that phase. The person to complete all three phases with the most points wins the game.

The start landing position is considered the first landing position of a phase, and the Olympia Gold circle is considered the last landing position of each phase.

If a disqualifying card is played, the Unified Rider is disqualified and the points are canceled. The Unified Rider may be reinstated at the identical position where he was disqualified, and the points remain valid if the reinstatement card is played before the next player rolls. Once the Unified Rider is disqualified he must roll a 1, 3 or 6 again to get on the board. This may occur at any time during the game between rolls. Once the Unified Rider reaches Olympia Gold circle he cannot be disqualified and continues on to the next phase.

There are three each Unified Rider reinstatement and disqualification cards. Holders do not have to disclose possession, and any number of cards may be held by any player. Once these cards are played they are returned to the deck. Timing of play for cards can be crucial to winning.

QUARANTINE PASS CARDS

There are three Quarantine Pass cards in the Good Luck deck. Possession need not be disclosed and cards may be passed from one player to another on the same team. Once a Quarantine Pass card is used it is returned to the bottom of the deck. The disqualifying, reinstatement, and quarantine pass cards are all the same color; therefore it is impossible to know what card a teammate or opponent is holding until the card is played. Timing is important with respect to when to play one of the cards.

It should be clear that, within the rules framework described for this preferred embodiment of the invention, any number of variations in the theme and therefore the educational definitions and associated game cards could be easily constructed.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. The method of playing a board game having playing pieces, a plurality of landing positions defining at least one path for advancing the playing pieces, a plurality of game cards imprinted with instructions and questions, and means for generating random numbers for determining by chance the number of landing positions to advance the playing pieces, said method comprising the steps of:

(a) assigning to each player a playing piece to be moved from landing position to landing position around the board in response to the randomly generated numbers and the instructions imprinted on said cards associated with labels on specific landing positions;

(b) awarding game points to players corresponding to point values associated with labels on certain landing positions on which the players' playing pieces land;

(c) awarding game points to players who correctly answer questions associated with labels on certain landing positions on which the players' playing pieces land;

(d) awarding game points to players who correctly define terms associated with labels on certain landing positions on which the players' playing pieces land;

(e) using at least one additional playing piece to be moved in turn around the board;

(f) assigning control of said at least one additional playing piece to selected players in turn;

(g) awarding game points to said at least one additional playing piece in accordance with point values associated with said labels on certain positions on which said at least one additional playing piece lands; and (h) awarding game points to said at least one additional playing piece for questions correctly answered and terms correctly defined by said selected player controlling said at least one additional playing piece.

2. The method of claim 1 further comprising the step of awarding game points won by said at least one additional playing piece to the game player first to accomplish a preselected game milestone.

3. The method of claim 1 wherein said labels depict terms associated with combined training equestrian events.

4. The method of claim 3 wherein said combined training equestrian events include the event of dressage.

5. The method of claim 3 wherein said combined training equestrian events include the event of stadium jumping.

6. The method of claim 3 wherein said combined training equestrian events include the event of cross-country.

7. The method of playing a board game comprising a board with a playing path, a random number generator, and playing pieces wherein playing pieces representing game players are moved around a board from landing position to landing position accumulating game points in sequential turn wherein:

at least one additional unassigned playing piece is moved around the board from landing position to landing position and accumulates game points as said unassigned playing piece is moved by each player in turn.

* * * * *